United States Patent [19]

Roraback

[11] Patent Number: 4,714,252

[45] Date of Patent: Dec. 22, 1987

[54] DUAL-WEIGHTED GOLF PUTTER HEAD

[76] Inventor: Harry G. Roraback, 55 Scenic Hill La., Monroe, Conn. 06468

[21] Appl. No.: 932,943

[22] Filed: Nov. 20, 1986

[51] Int. Cl.[4] ..... A63B 53/08

[52] U.S. Cl. ..... 273/171; 273/167 A

[58] Field of Search ..... 273/171, 167 A, 172, 273/174, 167 D, 167 F, 169, 173; D21/217, 218, 219

[56] References Cited

U.S. PATENT DOCUMENTS

| | | | |
|---|---|---|---|
| 3,680,868 | 8/1972 | Jacob | 273/167 A |
| 3,692,306 | 9/1972 | Glover | 273/171 X |
| 3,979,122 | 9/1976 | Belmont | 273/171 |
| 4,008,896 | 2/1977 | Gordos | 273/171 |
| 4,340,230 | 7/1982 | Churchward | 273/171 |

*Primary Examiner*—George J. Marlo

*Attorney, Agent, or Firm*—Kramer, Brufsky & Cifelli

[57] ABSTRACT

A golf putter comprises a putter head having a strike plate, a sole extending rearwardly from the lower portion of the strike plate and forming the bottom portion of the putter head and two weights respectively positioned near the toe and heel of the putter head. The weights are preferably steel spheres received in hemispherical cavities in the sole, with the greatest mass of the weights at approximately the midline of the strike plate. The hemispherical cavities intersect the bottom of the sole, so that the weights are visible. The putter head further comprises a top cover positioned behind the strike plate and above the sole, the top cover also having hemispherical cavities for receiving the upper portion of the weights. The top cover may be transparent, so that the weights are visible from the top of the club.

7 Claims, 5 Drawing Figures

FIG. 1
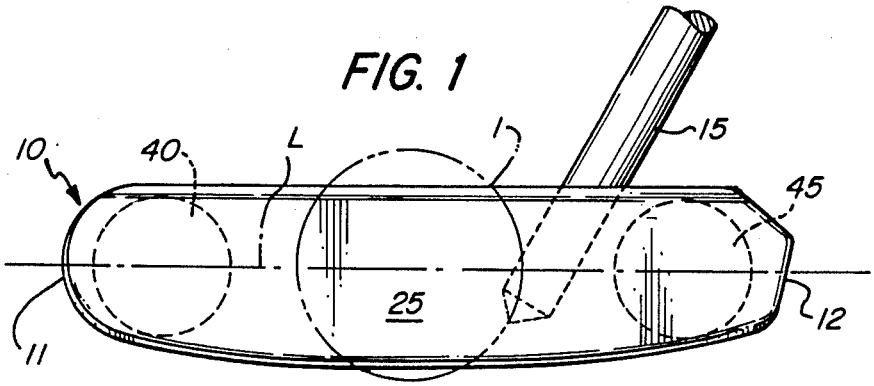
FIG. 2
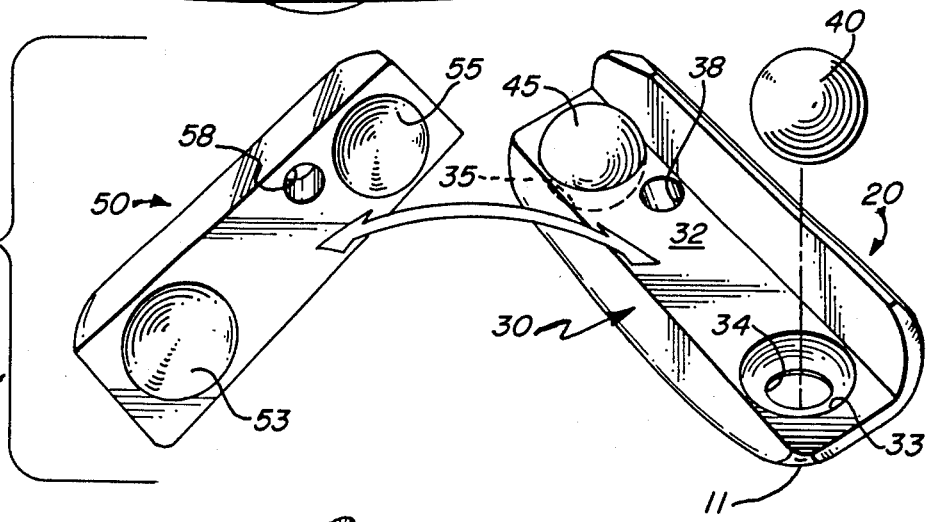
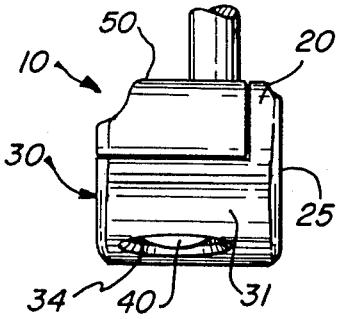
FIG. 3
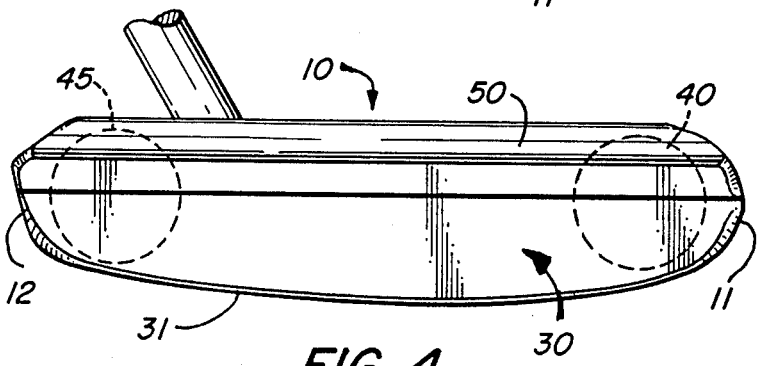
FIG. 4
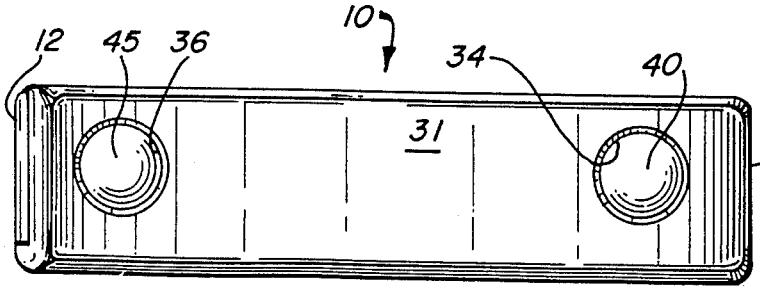
FIG. 5

DUAL-WEIGHTED GOLF PUTTER HEAD

BACKGROUND OF THE INVENTION

This invention pertains to a golf putter head which is weighted to achieve desirable putting characteristics.

In order to achieve a low score when playing the game of golf, it is necessary to putt well. Skill at putting is a combination of many factors, including the ability to judge the break and speed of the golf ball as it rolls across the green towards the hole, and the proper aim and stroke to impart the desired direction and speed to the golf ball. Golfers require a putter that contributes to hitting the ball accurately. Further, it is well-known that the many various putters available to golfers exhibit different characteristics, some of which may result in a subjective "feel" of the putter to the golfer. In any event, it is necessary that the golfer be comfortable with and have confidence in his putter.

One particular factor which may contribute to inaccurate putts is the rotation or twisting of the putter if the golf ball is struck slightly off center of the putter head.

SUMMARY OF THE INVENTION

A golf putter head according to the invention is adapted to be mounted on a shaft with a handle, to comprise a golf putter head. The putter head comprises an elongated strike plate defining a vertical surface for striking the golf ball and a sole extending rearwardly from the strike plate. The sole extends from the lower portion of the strike plate, whereby the putter head has a low center of gravity. The putter head further comprises a pair of weights which are fabricated of a material substantially heavier than the material of the soleplate. The weights are disposed one each at the toe and heel end of the putter head, respectively. In the preferred embodiment, the strike plate and sole are integrally fabricated of aluminum or another light metal, and the weights are fabricated of steel or a heavier metal. A light cover may be provided for enclosing the weights and for contributing to the overall solid appearance of the putter, and the cover may be fabricated of a transparent or translucent material so that the weights are visible.

In the preferred embodiment, the strike plate and sole are fabricated integrally, and the weights are provided in spherical form. The sole has a gentle curve from the toe to the heel, and the sole has hemispherical cavities for receiving the lower portions of spherical weights. A small portion of each spherical weight extends through the bottom of the sole, to make the weights visible. The putter head is attached to the lower end a shaft which has a handle on its upper end.

Accordingly, it is a principal object of the invention herein to provide a golf putter head which contributes to accuracy in putting.

It is an additional object of the invention herein to provide a golf putter head which resists rotation when striking a golf ball.

It is a further object of the invention herein to provide a golf putter head, the construction of which is visible to the golfer in order to inspire the golfer's confidence.

It is another object of the invention herein to provide a golf putter head which is relatively easy to fabricate.

These and other objects and features of the invention herein will in part be obvious and will in part appear from a perusal of the following description of the preferred embodiment and the claims taken together with the drawings.

DRAWINGS

FIG. 1 is a front elevation view of a golf putter head according to the invention herein;

FIG. 2 is an exploded perspective view of the golf putter head of FIG. 1;

FIG. 3 is an end elevation view of the toe of the golf putter head of FIG. 1;

FIG. 4 is a rear elevation view of the golf putter head of FIG. 1; and

FIG. 5 is a bottom plan view of the golf putter head of FIG. 1.

Same reference numerals refer to the same elements throughout the various figures.

DESCRIPTION OF PREFERRED EMBODIMENT

A putter head 10 according to the invention herein is illustrated in FIGS. 1–5. The putter head 10 has a generally elongated shape, extending from a toe end 11 to a heel end 12, and defines a flat face surface 25 for striking a golf ball, shown in phantom at 1 in FIG. 1. The putter head 10 is adapted for being mounted to a shaft 15, shown cut away in the drawings, and the upper end of the shaft 15 is provided with a grip or handle, not shown, in the usual fashion.

The putter head 10 comprises a strike plate 20, which forms the front portion of the putter head and defines the face surface 25. The face surface 25 is smooth and flat, so that the precise spot at which the face 25 contacts a golf ball during a putt is not determinative of the direction of the putt.

The putter head further comprises a sole 30, which makes up the lower portion of the putter head and defines the bottom surface 31 thereof. The bottom surface 31 is formed in a convex curve extending from the toe 11 to the heel 12 of the golf putter head, as best seen in FIGS. 1 and 4, so that neither the toe or the heel of the golf putter head will catch on the green and twist the club during a putting stroke.

In the preferred embodiment, the strike plate 20 and the sole 30 are integral, with the sole 30 extending rearwardly from the lower portion of the strike plate. The strike plate and sole may be fabricated of aluminum or another light metal.

The golf putter head 20 further comprises two weights 40 and 45, one of which is located near the toe end of the golf putter head and the other of which is located near the heel 12 thereof. The weights 40, 45 are preferably provided in the form of steel or other heavy metal spheres. The sole 30 defines two hemispherical cavities 33 and 35, which open upwardly and extend downwardly from a top surface 32 of the sole 30. The cavity 33 is located near the toe 11 of the golf putter head 10, and receives the spherical weight 40. As seen in FIGS. 2, 3 and 5, the hemispherical cavity 33 intersects the bottom surface 31 of the sole at an opening 34, wherein a portion of the weight 40 is visible on the bottom of the golf putter head 10. The weight 45 is similarly received in the hemispherical cavity 35, which also intersects the bottom surface 31 at an opening 36 through which a portion of the weight 45 is visible. The openings 34, 36 may be potted with a transparent plastic through which the weights are visible, or may be left open. The weights 40, 45 may be secured in the hemispherical cavities 33, 35 by means of an epoxy, if desired, and the weights may be further secured in position by a cover plate, as more fully described below.

The sole 30 defines a further opening 38 which receives and mounts the shaft 15.

Although the putter may be utilized with the structure described above, namely the strike plate, sole and weights, the preferred embodiment further includes a top cover of 50. As best seen in FIGS. 3 and 4, the top cover of 50 is positioned generally over the sole 30, adjacent the rear of the upper portion of the strike plate 20. The top cover 50 is provided with two hemispherical concave cavities 53 and 55, which fit over the weights 40 and 45, respectively. The top cover 50 further defines an opening 58, through which the shaft 15 is accommodated. With the top cover 50 in position, the exterior of the golf putter head has a generally smooth, solid appearance.

The top cover 50 may be fabricated of wood to provide an elegant and custom look to the golf putter head. Alternatively, the top cover 50 may be fabricated of a transparent or translucent material, such as an acrylic, wherein the weights 40 and 45 are visible to the golfer as he views the golf putter head from the top, i.e. when it is in use. In any event, the top cover 50 is fabricated of a lighter weight material than the sole.

The provision of weights near the toe and heel of the golf putter head 10 contribute to its accurate putting of a golf ball. In particular, the weights at the toe and heel of the golf putter head cause the golf putter head to resist twisting during the putting stroke, including the instant of striking the ball. Additionally, the use of discreet weights permits a greater concentration of weight near the toe and heel of the golf club than is achieved by merely forming a golf putting head from a single material with enlarged end portions. Further, the provision of weights near the toe and heel of the club inspire confidence in the golfer using the golf putter head, particularly when the weights are visible through either or both of the bottom surface and the top cover of the golf putter head. The spherical weights are also positioned for good striking action on the ball, more particularly, a line L connecting the centers of mass of the weights is at the level at which the strike plate normally contacts a golf ball during a putting stroke, as best seen in FIG. 1.

Accordingly, the golf putter head described above admirably achieves the objects of the invention herein and is well adapted to its intended task. It will be appreciated that the golf putter head described above is illustrative of the invention, but that modifications may be made by those skilled in the art without departing from the spirit and scope of the invention, which is limited only by the following claims.

I claim:

1. A golf putter head adapted to be mounted on a shaft having a handle to form a golf putter, the golf putter head comprising:

(A) an elongated strike plate defining a substantially flat face surface for striking a golf ball, the face surface extending from a toe end of the golf putter head to a heel end of the golf putter head;

(B) a sole extending rearwardly from the lower portion of the strike plate, the sole forming the lower portion and defining the bottom surface of the golf putter head;

(C) a weighting means comprising solely a pair of spherical weights fabricated of a heavier material than the sole, one of the weights being mounted behind the strike plate near the toe of the golf putter head and the other of the weights being mounted behind the strike plate near the heel of the golf putter head said sole being convexly curved from the toe to the heel, and further defining hemispherical cavities for receiving the spherical weights, said cavities intersecting the bottom surface of the sole so that the weights are visible through the bottom surface of the putter head.

2. A golf putter head as defined in claim 1 wherein the strike plate and sole are integral.

3. A golf putter head as defined in claim 1 wherein the sole and strike plate are fabricated of aluminum and the weights are fabricated of steel.

4. A golf putter head as defined in claim 1 and further comprising:

(D) a top cover extending rearwardly from the strike plate above the sole, said top cover being fabricated of a material having a lighter weight than the sole.

5. A golf putter head as defined in claim 1 and further comprising a top cover positioned above the sole and behind the strike plate.

6. A golf putter head as defined in claim 5 wherein the top cover is fabricated of a transparent material so that the weights are visible therethrough.

7. A golf putter head as defined in claim 5 wherein the top cover is fabricated of wood.

* * * * *